US005538324A

United States Patent [19]

Haber-Shomaker

[11] Patent Number: 5,538,324

[45] Date of Patent: Jul. 23, 1996

[54] BABY SWING LEG EXTENSION

[76] Inventor: Cindy A. Haber-Shomaker, 1322 S. 52nd St., Omaha, Nebr. 68106

[21] Appl. No.: 301,072

[22] Filed: Sep. 6, 1994

[51] Int. Cl.[6] ..... A47C 7/52; A47D 1/00

[52] U.S. Cl. ..... 297/423.39; 297/423.4

[58] Field of Search ..... 297/423.1, 423.39, 297/423.4; 5/624, 648

[56] References Cited

U.S. PATENT DOCUMENTS

| | | | |
|---|---|---|---|
| D. 182,954 | 6/1958 | Hana | 297/423.1 X |
| D. 192,558 | 4/1962 | Barker | 297/423.1 X |
| 183,475 | 10/1876 | Weddle . | |
| 866,316 | 9/1907 | Watson | 297/423.4 |
| 2,163,198 | 6/1939 | Gossard | 155/165 |
| 2,614,613 | 10/1952 | Bushong | 297/433 |
| 2,615,503 | 10/1952 | Enge | 155/169 |
| 3,637,260 | 1/1972 | Eisenhauer | 297/423.39 X |
| 4,728,151 | 3/1988 | Neufeld | 297/438 |
| 4,744,599 | 5/1988 | Jankowski et al. | 297/273 X |

FOREIGN PATENT DOCUMENTS

| | | | |
|---|---|---|---|
| 1136462 | 9/1962 | Germany . | |
| 2194731 | 3/1988 | United Kingdom | 297/423.4 |

*Primary Examiner*—Peter R. Brown
*Attorney, Agent, or Firm*—Law Firm of John A. Beehner

[57] ABSTRACT

A baby swing seat having a generally horizontal seating member with top and bottom surfaces, a generally upright back support and two arm rest support members. The detachable leg extension is adapted to be placed adjacent the seating member top surface and adapted to extend generally horizontally and forwardly of the seating member, thereby supporting the legs of a baby seated in the swing seat. The seat may also be configured with a cross-member extending between the support arms to provide additional positioning support. Additionally, the rearward end of the seat may be of increased thickness to provide additional support.

7 Claims, 6 Drawing Sheets

BABY SWING LEG EXTENSION

BACKGROUND OF THE INVENTION

1. Technical Field

The method and apparatus of the present invention relate generally to an apparatus and method of providing a more comfortable and safe means for a baby to sit in a baby swing seat. More specifically, it relates to an apparatus and method wherein a leg extension apparatus is adapted to be associated with a conventional baby swing seat so as to provide a means for resting the feet and legs of a baby in a more comfortable position. The apparatus provides not only a more comfortable seating position for the baby but also provides some health benefits in that the circulation in the baby's legs while seated in the seat is greatly enhanced. Thus, a baby may be left in the seat for a longer time than otherwise possible.

Currently, baby seats are designed in such a way that when seated therein, the legs and feet of the baby dangle over the front edge of the seat. This design reduces the amount of circulation in the legs and feet of the baby thereby causing the legs to "fall asleep" after a period of time. Babies react to this situation as they do to any situation where discomfort exists, namely by crying or otherwise fidgeting in the seat. Prolonged loss of circulation in the extremities can of course lead to more serious health consequences. Consequently, it is highly desirable to provide a mechanism for maintaining the baby's feet and legs in a more horizontal orientation so as to prevent the restriction of circulation which can come from a conventional seat design. At the same time, however, it would be desirable that such an apparatus be adaptable for use with conventional baby seats since the number of conventional baby seats in existence is considerable. Such an apparatus would find greater acceptance in the market place if the owners of these conventional baby seats were not required to purchase an entirely new seat.

2. Description of the Prior Art

Prior art baby seats are of the general design wherein the seat comprises a horizontal seating portion, a generally upright back support portion and two opposite side members for providing arm support and retaining the baby within the seat. The generally horizontal seating portion is designed to be of a size to permit the baby to sit thereon. The design of the seat causes the baby's legs to dangle over the forward portion thereof. It is this dangling of the legs which restricts circulation in the legs and leads to the discomfort of the infant addressed by the present invention.

Additionally, several prior art leg support apparatuses have been designed. One example of such a prior art leg support apparatus is represented in Eisenhauer, U.S. Pat. No. 3,637,260. Eisenhauer discloses a leg support apparatus comprising essentially a flat board which pivots from an inclined position resting on the forward portion of a chair, to a horizontal position as the person is seated in the chair. Unfortunately the Eisenhauer device is unacceptable for use in the baby swing seat environment since it is of a size and shape incompatible with seating a baby thereon.

Another prior art example of a leg rest is Mead, U.S. Pat. No. 2,735,480, which discloses a seat and leg rest having a three-section, pivotally connected frame and fabric cover. Unfortunately, this also would be unacceptable in the baby swing seat environment since it appears the Mead apparatus is adapted to be use as a seat substitute with the three framed sections corresponding to a back, seat and leg rest. Therefore, Mead would not be appropriate with a swing seat already having back and seating portions.

Therefore, it is a primary objective to provide a leg extension apparatus which will provide support for the baby's legs and on which the baby may be directly seated eliminating the need to lift its legs.

It is a further objective of the present invention to provide a leg support extension which is adaptable to conventional baby swing seats such that the seat does not require any modification to accommodate the leg extension apparatus.

It is a further objective of the invention to provide a leg support apparatus which is adaptable to be placed directly on the upper surface of the seat and upon which the baby may be seated thereby retaining the leg support apparatus in proper position.

It is an alternative objected to provide a leg support apparatus which is adapted to be received in a slotted flange extending downwardly from the seating portion of the swing seat thereby providing a means for retaining the leg support apparatus in proper position forwardly of the seating member.

It is another objective of the invention to provide a leg support apparatus which is constructed of a single seat of semi-rigid material such as plastic or the like such that the leg support apparatus is extremely durable.

SUMMARY OF THE INVENTION

A baby swing seat having a generally horizontal seating member with top and bottom surfaces, a generally upright back support and two arm rest support members. The detachable leg extension is adapted to be placed adjacent the seating member top surface and adapted to extend generally horizontally and forwardly of the seating member, thereby supporting the legs of a baby seated in the swing seat. The seat may also be configured with a cross-member extending between the support arms to provide additional positioning support. Additionally, the rearward end of the seat may be of increased thickness to provide additional support.

DESCRIPTION OF THE PREFERRED EMBODIMENT

Figure 1:
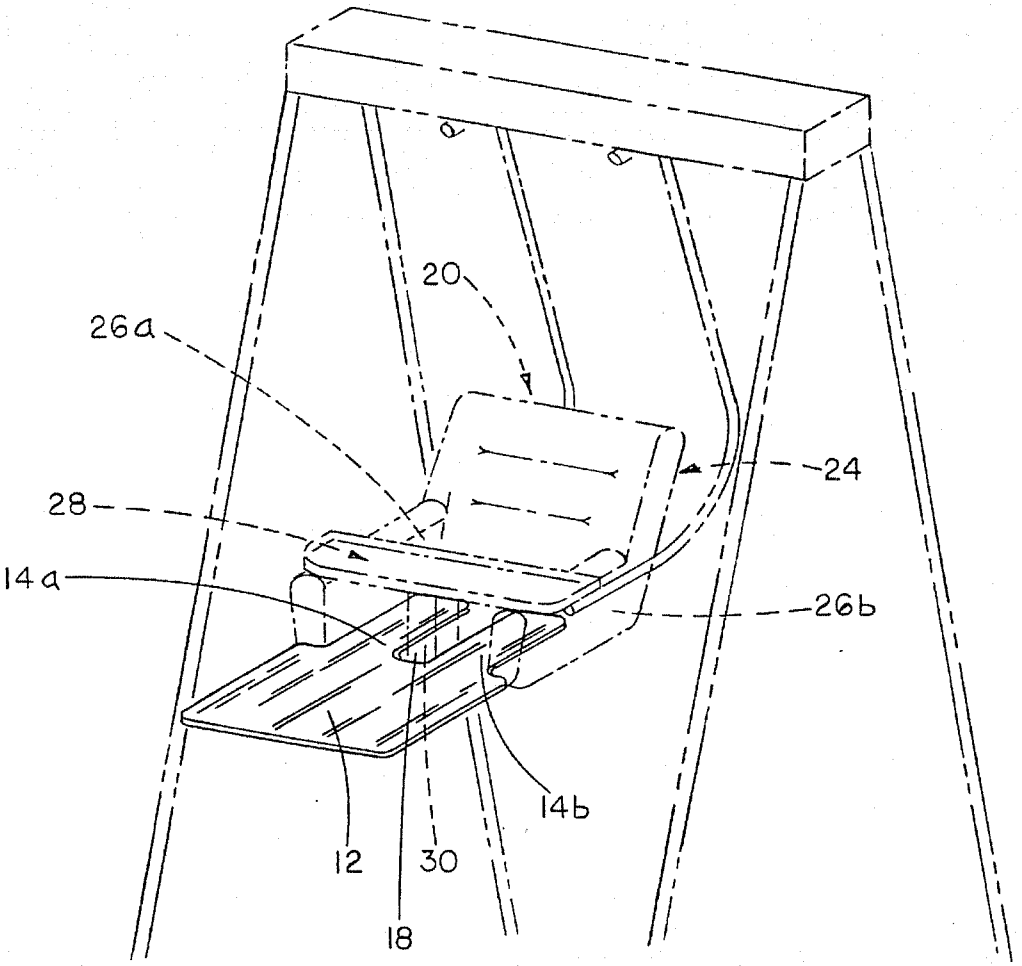
FIG. 1 is a perspective view showing the baby swing seat leg support apparatus of the present invention installed on a conventional baby swing seat.

The operation of the first embodiment of the invention is best illustrated in FIG. 1. The invention is adapted to be used with a conventional baby seats without the need for modifications thereto. Current manufacturers of such seats are Graco, Kolcraft, Cosco, Gerry, Century as well as others. As seen in the figure, the essential elements of a conventional baby seat 20 are illustrated as the back support 24, the seating surface 22, and sides 26*a* and *b*. In most cases, a seat would also be provided with tray 28. Tray 28 is generally designed to be pivoted from an upright storage position to a lowered seating position. Additionally, most baby seat trays are provided with an upright tray post 30 as illustrated, the purpose of which being to maintain the tray in the correct horizontal position when pivoted downwardly as indicated in the figure. Post 30 also provides a means for restricting the outward or forward motion of the baby when it is seated therein.

The leg support apparatus 10 is shown installed in one of the mounting method embodiments. In this embodiment, the support arms 14*a* and *b* are placed adjacent the top surface of the seating member 22 of the conventional chair 20. Due to the weight distribution in the apparatus 10 it is able to maintain a stable position when installed as indicated, even without the child's weight thereon. As seen in the figure, the leg support apparatus 10 comprises a generally rectangular leg support surface 12 and support arms 14*a* and *b* extending rearwardly thereof.

As shown in the figure, support arms 14*a* and *b* are mounted to rectangular support surface 12 so that a spaced relation is maintained between support arms 14*a* and *b*. The securement of arms 14*a* and *b* as illustrated provides a space 18 in which the tray post 30 may be received as illustrated. When installed in seat 20, the baby would be seated on support arms 14*a* and *b*. In a normal seating position, this would cause the baby's legs and feet to project outwardly from seat 20 and rest on the top surface of rectangular support surface 12. Thus, horizontal support for the baby's legs and feet would be provided.

Figure 2:
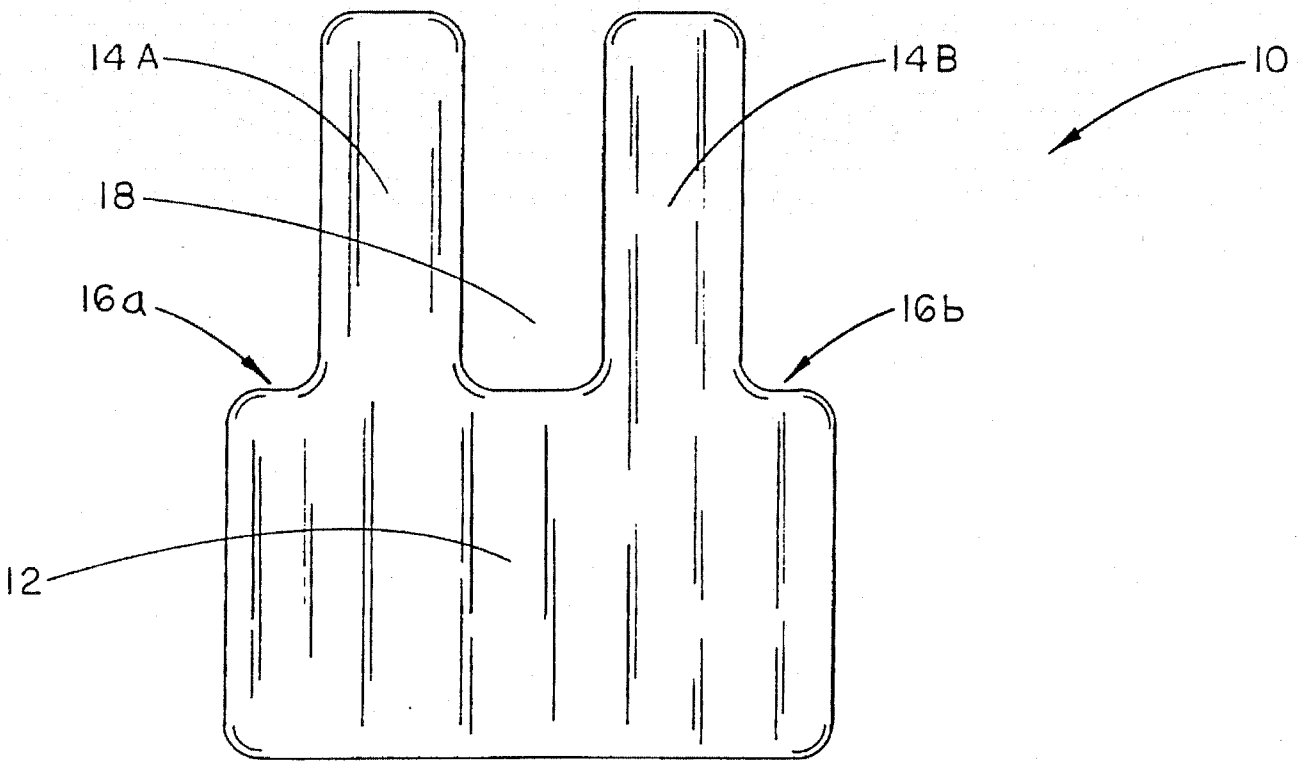
FIG. 2 is a top view of the leg support apparatus.

FIG. 2 is a top view of the leg support apparatus illustrating with particular clarity the shapes and orientations of various components of the apparatus 10. As seen, the leg support surface 12 is generally rectangular in shape. The two support arms 14*a* and *b* extend rearwardly therefrom and in a spaced relation between each other. As mentioned above, it is the spaced relation between support arms 14*a* and *b* which allows the reception of tray post 30 therebetween. It will also be noted that the rectangular support surface 12 extends beyond support arms 14*a* and *b* as indicated by areas of 16*a* and *b*. The purpose behind such extension is to provide additional area for the support of the baby's feet and legs so that it may move about while seated and still finds support form rectangular surface 12.

Figure 3:
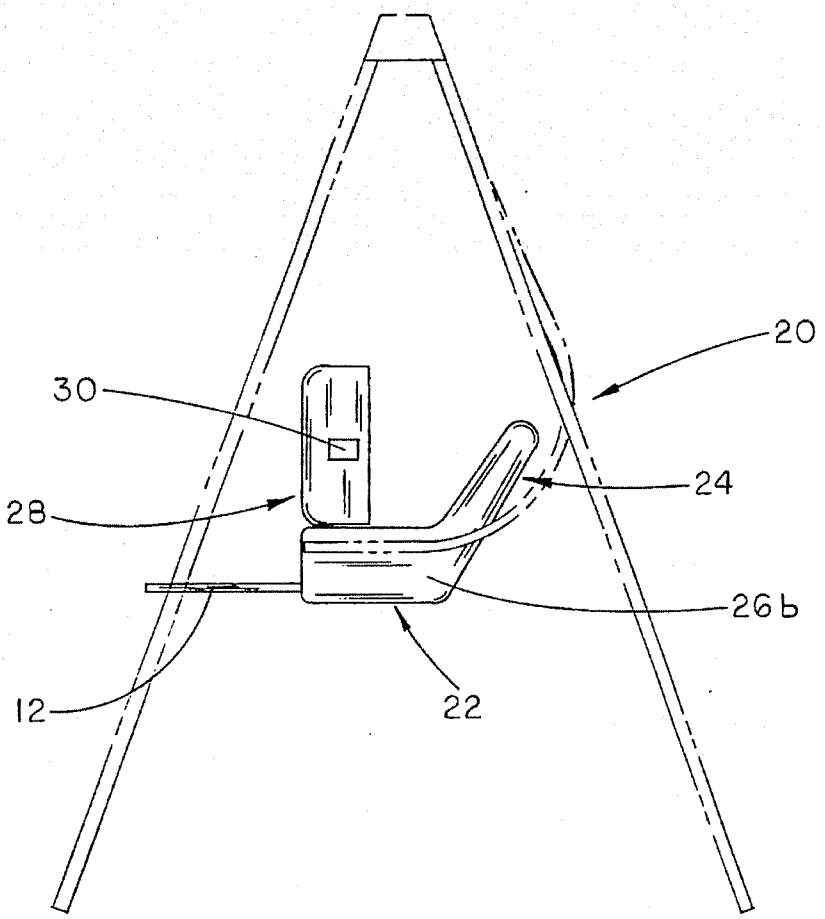
FIG. 3 is a side view of the leg support apparatus installed on a conventional baby swing seat.

FIG. 3 is a side view of the apparatus of the present invention installed on a conventional baby swing. As seen in this figure, the horizontal support surface 12 protrudes forwardly from chair 20 so as to provide a surface on which the baby's feet and legs may rest. Also shown in the figure is tray 28 positioned in the upright, storage position which allows the baby to be placed in the seat and removed therefrom.

Figure 4:
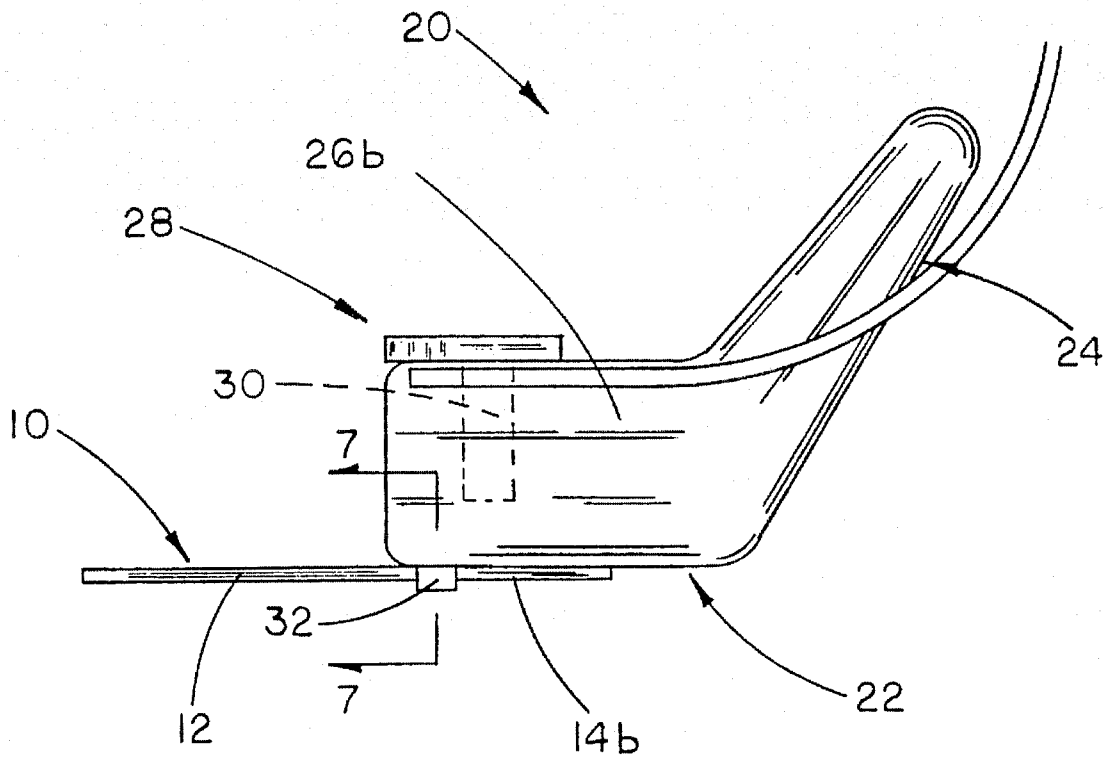
FIG. 4 is a side view showing an alternative embodiment wherein the leg support apparatus is received by a slotted flange member depending from the forward portion of the seat.
Figure 7:
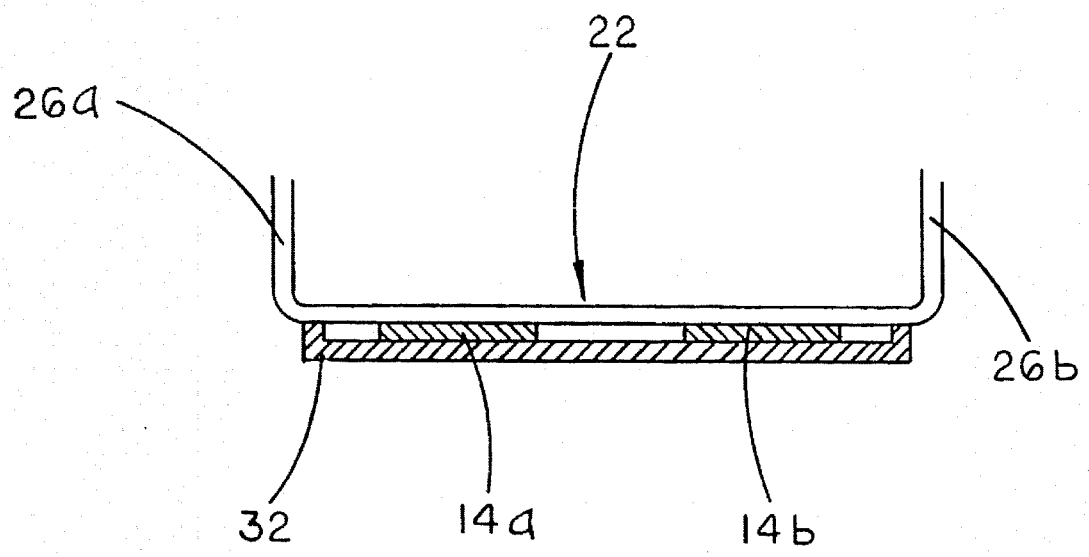
FIG. 7 is a cross-sectional view taken along the lines shown in FIG. 4 showing the embodiment wherein the leg support apparatus is received by a slotted flange below the seat.

FIGS. 4 and 7 are side and cross-sectional views respectively of an alternative embodiment of the present invention. As seen in these figures, the leg support apparatus 10 is shown installed in chair 20. In this embodiment, instead of the support arms 14*a* and *b* resting on the top surface of seating member 22, support arms 14*a* and *b* are inserted through a slotted flange 32 which extends downwardly from the forward portion of seating member 22. The weight of the rectangular support surface 12 urges the support arms 14*a* and *b* into contact with the bottom of seating member 22 thereby retaining the support apparatus 10 in position. The support apparatus 10 otherwise functions in a manner similar to that described above wherein the rectangular support surface 12 would provide a surface upon which the baby's legs and feet may be rested when it is seated in seat 20.

Figure 5:
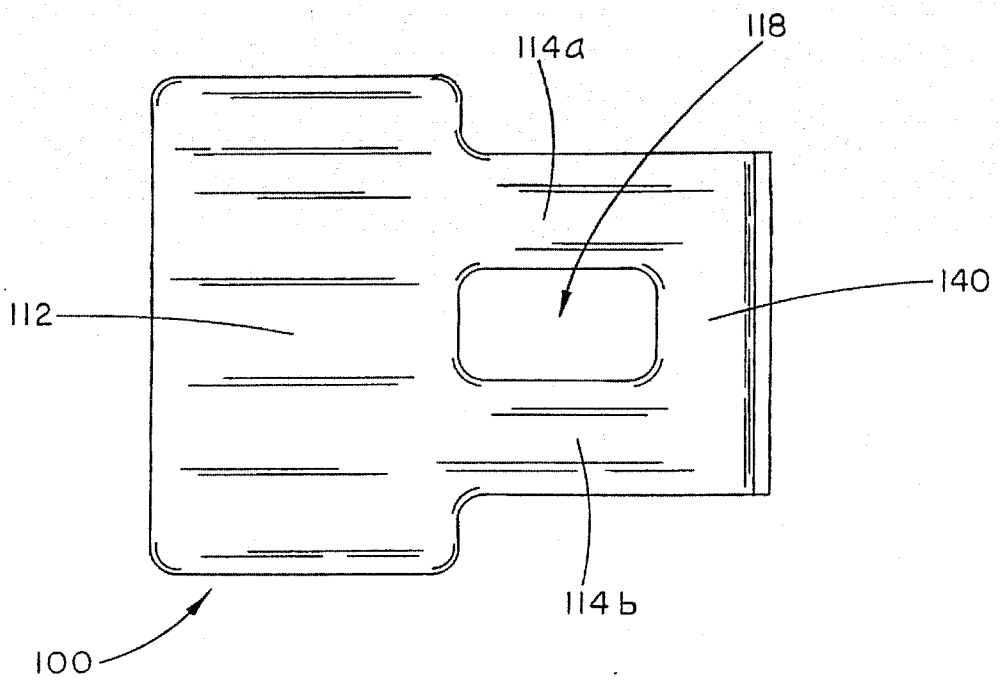
FIG. 5 is a top view of another alternative embodiment of the present invention utilizing a cross member for additional stability.
Figure 6:
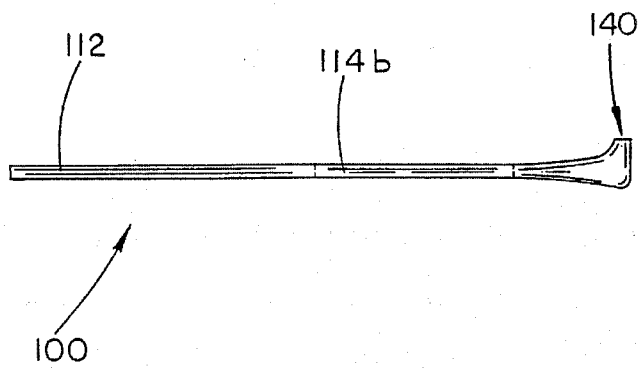
FIG. 6 is a side view of another alternative embodiment wherein the rearward ends of the leg support apparatus are thicker than the remaining portion and wherein the ends have been flared upwardly.

FIGS. 5 and 6 are top and side views respectfully of an alternative embodiment of the leg extension apparatus of the present invention. As shown in the top view of FIG. 5, a distinguishing feature of this embodiment is cross member 140. The purpose of cross member 140 is two-fold. First, it provides an additional support surface on which the baby sits, thereby adding additional positional stability to the leg extension. Secondly, cross member 140 in conjunction with support arms 114*a* and *b* and support surface 112 form a closed loop. As mentioned above, the upright tray post 30 of tray 28 would be positioned between support arms 114*a* and *b*. Thus, cross member 140 provides a further retention of the support apparatus 100 by limiting the forward movement of the apparatus 100 when the tray is in the down position, due to contact between member 140 and tray post 30.

The side view of the this embodiment shown in FIG. 6 illustrates a second distinguishing feature of this alternative embodiment. As seen in this figure, cross member 140 has an upward slope in the rearward portion thereof. Additionally, it is seen that support arms 114*a* and *b* and cross member 140 are somewhat thicker than the remaining portions of the seating apparatus 100. The increased thickness of the rearward portion of arms 114*a* and *b* and cross member 140 provide additional weight in the rearward section of the seating apparatus thereby providing additional means for retaining the support apparatus in the proper position once installed in the seat 20. The upward sloping feature of cross member 140 is further adapted to conform to the baby when seated in the baby seat 20, again providing some additional positional stability to the apparatus.

It is obvious that numerous other modifications and variations of the present invention are possible in view of the above teachings. For example, one possible variation is the means by which the leg support apparatus 10 would be connected to the seat 20. As described above in two alternative embodiments, the support arms 14*a* and *b* may be rested on the top surface of seating member 22 or alternatively received by a slotted flange 32 wherein the weight of rectangular support surface 12 would urge the support arms 14*a* and *b* in contact with the bottom of seat 22.

Therefore it is to be understood that the above description is intended in no way to limit the scope of protection of the claims and is representative of only three of the several possible embodiments of the present invention. For example, in an alternate embodiment, the leg support apparatus could be mounted on the baby seat as a pullout tray so as to be movable between use and storage positions.

Thus has been shown and described an invention which accomplishes at least all of the stated objectives.

I claim:

1. A detachable leg extension for a baby swing seat adapted to receive and support the legs of a baby in a generally horizontal position thereby greatly enhancing circulation in the baby's legs, the baby swing seat having a generally horizontal sating member, a generally upright back support and two arm rest support members and a tray adapted to be positioned forwardly of the baby and wherein the tray has a depending post adapted to contact the seating member and support the tray, the detachable leg extension comprising:

a forward leg support portion having outwardly extending lateral wing portions, such that said forward leg support section has a width greater than the width of a baby swing seat; and a pair of arms projecting rearwardly therefrom and defining a space therebetween for receiving the depending post of a baby swing seat.

2. The combination of claim 1 wherein said forward leg support portion is generally rectangular in shape.

3. The detachable leg extension apparatus of claim 1 wherein said apparatus is generally flat.

4. The detachable leg extension apparatus of claim 1 wherein said apparatus is constructed of plastic.

5. The invention of claim 1 wherein said detachable leg extension further comprises a cross-member secured to said arms opposite said forward leg support portion.

6. The invention of claim 1 wherein the rearward portion of said arms comprises a thickness greater than the forward portion of said arms and further wherein said cross-member comprises a thickness in the rearward portion greater than in the forward portion thereof.

7. A method of supporting a baby's legs in a generally horizontal position, thereby increasing the circulation therein, comprising;

providing a baby swing seat having a generally horizontal seating member having top and bottom surfaces, a generally upright back support and two arm rest support members;

providing a detachable leg extension adapted to be placed adjacent said seating member top surface and adapted to extend horizontally and forwardly of said seating member and whereupon a baby's legs may be placed in a resting position, the leg extension having a generally rectangular forward leg support portion and a pair of arms projecting rearwardly therefrom and defining a space therebetween, the interconnection of said pair of rearwardly projecting arms with said forward leg support portion being spaced inwardly of the lateral edges of said forward portion, such that said forward leg support portion has a width greater than the width of said seating member of said baby swing seat;

positioning said leg extension arms adjacent said seating member top surface;

placing the baby in the swing seat so that it is seated on said extension arms thereby retaining said leg extension in place; and positioning the baby's legs on said generally forward rectangular portion.

* * * * *